United States Patent [19]

Mally

[11] 3,958,200

[45] May 18, 1976

[54] BLADE CONSTRUCTION FOR RELAY

[75] Inventor: Frank X. Mally, Crystal Lake, Ill.

[73] Assignee: Guardian Electric Manufacturing Company, Chicago, Ill.

[22] Filed: Jan. 9, 1975

[21] Appl. No.: 539,772

[52] U.S. Cl. ..... 335/275; 335/187; 339/256 R

[51] Int. Cl.[2] ..... H01H 50/28

[58] Field of Search ..... 335/275, 276, 187; 339/95, 256, 17 C; 200/335, 338, 339

[56] References Cited

UNITED STATES PATENTS

| | | | |
|---|---|---|---|
| 3,020,452 | 2/1962 | Tudbury | 335/275 |
| 3,211,874 | 10/1965 | Bengtsson | 339/256 R |
| 3,551,875 | 12/1970 | Jarosek | 339/256 SP |
| 3,868,163 | 2/1975 | Jarosek | 339/256 R |

*Primary Examiner*—Harold Broome

*Attorney, Agent, or Firm*—Allegretti, Newitt, Witcoff & McAndrews

[57] ABSTRACT

An improved spring leaf construction for relays includes a cantilever blade fabricated to cooperate with a tapered lead post. The end of the blade which is attached to the post includes a pair of parallel slits defining a bridging portion. The bridging portion is friction fitted over the post and tightly engages that post. Preferably, a tapered post construction is utilized in combination with the improved cantilever blade.

3 Claims, 6 Drawing Figures

BLADE CONSTRUCTION FOR RELAY

BACKGROUND OF THE INVENTION

In a principal aspect, the present invention relates to an improved relay construction and, more particularly to a spring leaf construction for relays.

A spring leaf is utilized in association with a relay generally as a contact blade. On occasion, a spring leaf construction is utilized in association with a relay armature to bias that armature in a first direction opposite the direction imparted by a relay coil.

In the past, it has been the practice to mount such a spring leaf construction in a block of material between insulating spacers. Other constructions include a wrap-around opening formed at the end of the blade and adapted to cooperate with the post.

Among the problems noted with such prior art structures is one of breakage. With continuous use of such spring leaf constructions, often the spring leaf will tend to fracture at the point of connection to a post. For example, constant bending of a wrap around post construction, though operative, may not last as long as desirable.

Thus, while these structures are quite suitable for their purpose, an improved construction is desirable. Such an improved construction would eliminate the above-noted problems.

SUMMARY OF THE INVENTION

In a principal aspect, the present invention comprises an improved spring leaf construction which includes a cantilever blade having a contact end and a post connection end. The post connection end is made from a continuous planar extension of the blade and includes first and second parallel slits defining an intermediate portion and adjacent side portions. These portions are flexed transverse to the plane of the blade to define an opening that is cooperative with a post. In a preferred embodiment of the invention, the spring leaf construction is combined with a tapered post.

Thus, an object of the present invention is to provide an improved spring leaf construction, especially for use with relays including the contact blades of relays as well as armature mounting members for relays.

Another object of the present invention is to provide an improved spring leaf construction which may be easily fabricated and easily assembled in combination with a relay construction.

One further object of the present invention is to provide an improved spring leaf construction having an improved post connection structure for attachment of the spring leaf to a post of a relay.

These and other objects, advantages and features of the present invention will be set forth in the detailed description which follows.

DESCRIPTION OF THE DRAWING

In the detailed description which follows, reference will be made to the drawing comprised of the following FIGS..

DESCRIPTION OF THE PREFERRED EMBODIMENT

Figure 1:
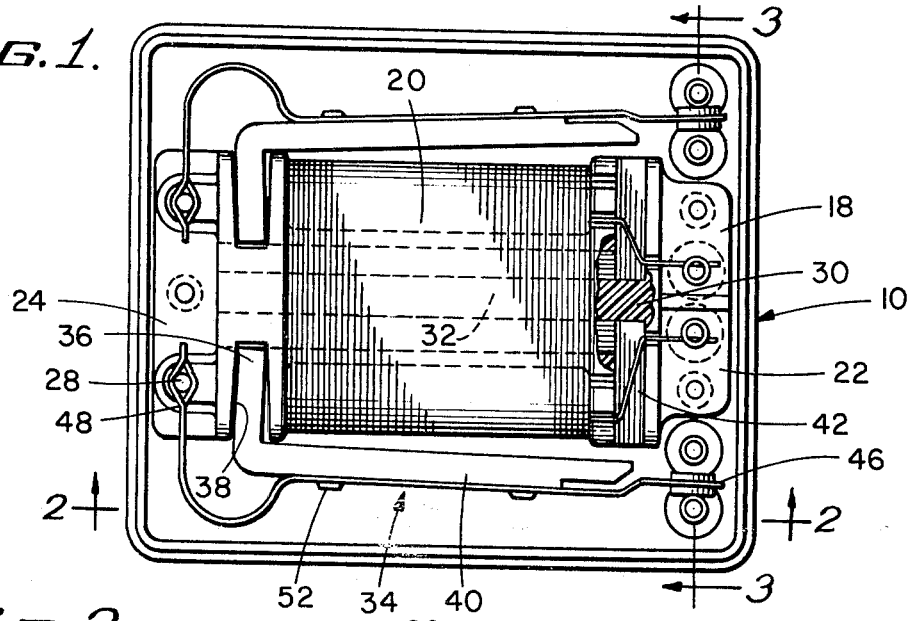
FIG. 1 is a top plan view of a relay incorporating the improved spring leaf construction of the present invention.
Figure 2:
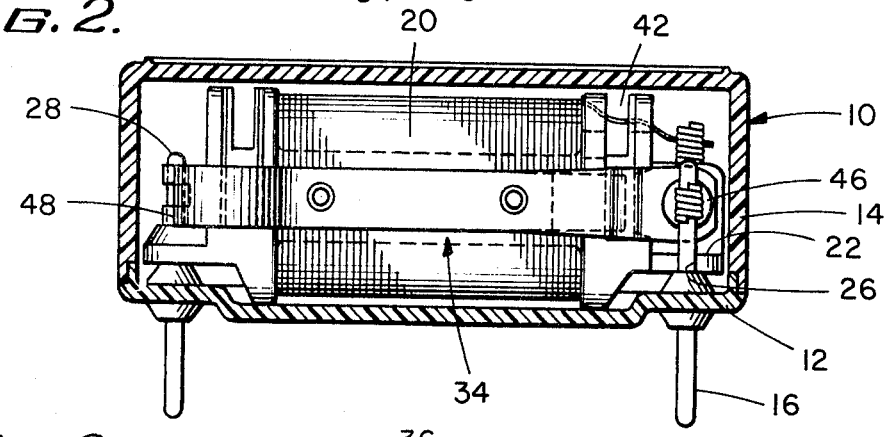
FIG. 2 is a cross sectional view of the relay of FIG. 1 taken substantially along the line 2—2.
Figure 3:
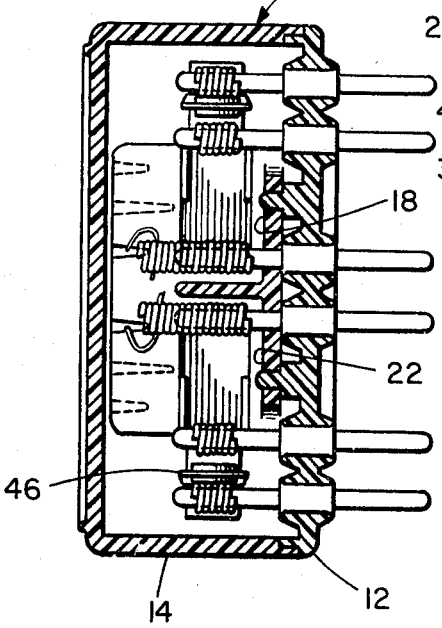
FIG. 3 is a cross sectional view of the relay of FIG. 1 taken substantially along the line 3—3.

Referring first to FIG. 1, a typical relay construction is shown including the improved construction of the present invention. The relay is mounted in a housing 10 preferably formed from a plastic material. Housing 10 is comprised of a base section 12 and a cover section 14. A plurality of contact posts 16 are molded into the base section 12. A bobbin structure 18 for a coil 20 includes flanges 22 and 24 having openings therein as at 26. The openings 26 coincide with upstanding pins 28 of the contact posts 16 to thereby position the bobbin 18 and coil 20 within the housing 10.

Figure 4:
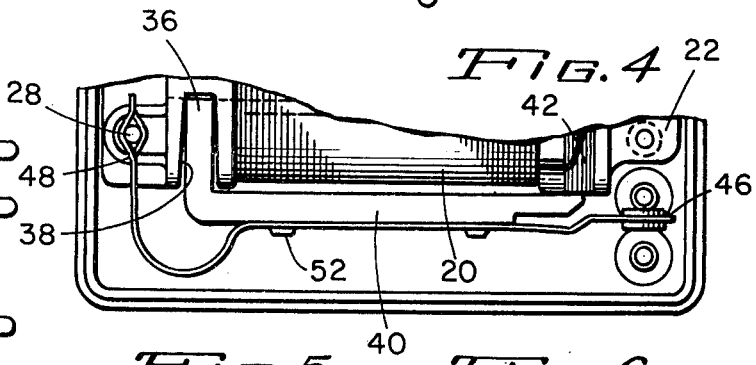
Fig. 4 is a partial top plan view of the relay of FIG. 1 wherein the armature has been actuated by passage of current through the coil of the relay.

An iron core field piece 30 is positioned in an opening 32 defined on the interior of the bobbin 18. A L-shaped armature 34 includes a short side 36 which fits in a slot 38 in the bobbin 18. The long side 40 of armature 34 spans the coil of the bobbin 18 and is adapted to engage transverse field pieces 42 defined at the end of the bobbin 18. Thus, when the armature 34 is positioned as shown in FIG. 4, it provides a closed magnetic loop.

The spring blade construction of the present invention is illustrated as being incorporated with armature 34. A spring leaf 44 is fabricated from a metallic spring leaf material of the type well known to those skilled in the art. This material is preferably a conductive material. THe spring leaf 44 includes a contact end 46 and a post attachment end 48. A pair of opposed contacts 50 are attached to the contact end 46 and positioned to engage contacts defined on upstanding posts or pins 28, depending upon the biasing forces being exercised on blade 44.

The spring leaf or blade 44 is attached to the armature 34 by means of rivets 52. The blade 44 is substantially L-shaped with a semi-circular portion 54 interconnecting the legs of the blade 44 forming the L shape.

Figure 5:
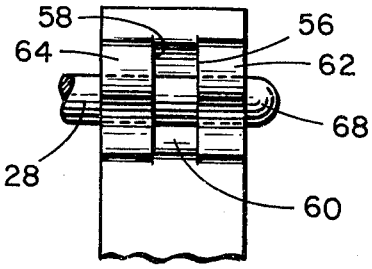
FIG. 5 is an enlarged plan view of the spring leaf construction in combination with the post of a relay.
Figure 6:
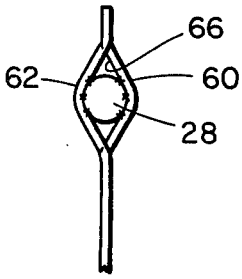
FIG. 6 is an end view of the spring leaf construction illustrated in FIG. 5.

The post end 48 of the blade 44 is illustrated more detail in FIGS. 5 and 6. There, it is shown that the post end includes first and second slits 56 and 58 which extend substantially parallel to the longitudinal axis of the blade 44. The slits 56 and 58 define an intermediate portion 60 and adjacent side portions 62 and 64 in the blade 44 at post end 48. Each of the portions 60, 62 and 64 are substantially the same width. As shown in FIG. 6, these portions are extended or formed in opposed directions from the plane defined by the blade 44. That is, intermediate portion 60 extends transversely to the right in FIG. 6 whereas side portions 62 and 64 extend transversely to the left to provide an opening 66 for receipt of a pin 28. Preferably the pin 28 which includes an outside end 68 is tapered or of frusto-conical shape with the narrow dimension adjacent the outside end 68. In this manner, when the post end 48 of the blade 44 is fastened to the post 28, it tends to be wedge locked in place.

It is also to be noted that the edge surfaces of portions 60, 62 and 64 tend to cut into and thereby grip the post or pin 28 more firmly. This is termed a scarifying action. That is, the edges of the portions 60, 62 and 64 cut into the pin 28, thereby locking the blade 44 tightly on that pin preventing not only removal of the blade 44 but rotation thereof. It is because of this action that the blade 44 may be used as a biasing spring blade in combination with an armature 34 or a contact as illustrated in FIG. 1.

While in the foregoing, there has been presented a preferred embodiment of the present invention, it is to be understood that other embodiments may be within the scope of the following claims. Therefore, the invention is to be limited only by the following claims and their equivalents.

What is claimed is:

1. An improved spring leaf construction for relays comprising, in combination:

a generally cylindrical post having circular cross section; and a cantilever blade having a contact end and a post connection end, said post connection end including a continuous, planar section with first and second parallel slits extending substantially in the direction of the longitudinal axis of the blade, said slits defining an intermediate portion and flanking side portions, said intermediate portion extending transversely from said side portions to define an opening encircling the post and edges scarifying said post, whereby said blade is retained in substantially non-rotatable position on said post to provide a spring leaf.

2. The improved construction of claim 1 in combination with a tapered post, said post tapered to define a substantially frusto-conical surface.

3. The improved construction of claim 1 in combination with a relay of the type including a coil and an armature pivotally mounted for response to current through said coil, said cantilever blade being attached to said armature and normally biasing said armature in a first direction opposite the direction imparted by current in said coil to said armature.

* * * * *